US011213067B2

(12) United States Patent
Rix et al.

(10) Patent No.: US 11,213,067 B2
(45) Date of Patent: Jan. 4, 2022

(54) HOOKAHS, HEATING UNITS, AND RELATED METHODS

(71) Applicant: Starbuzz Tobacco, Inc., Garden Grove, CA (US)

(72) Inventors: John Fred Rix, Tucson, AZ (US); Haytham Kalasho, Escondido, CA (US)

(73) Assignee: Starbuzz Tobacco, Inc., Garden Grove, CA (US)

( * ) Notice: Subject to any disclaimer, the term of this patent is extended or adjusted under 35 U.S.C. 154(b) by 268 days.

(21) Appl. No.: 16/389,735

(22) Filed: Apr. 19, 2019

(65) Prior Publication Data

US 2019/0320712 A1 Oct. 24, 2019

Related U.S. Application Data

(60) Provisional application No. 62/661,539, filed on Apr. 23, 2018.

(51) Int. Cl.
*A24F 1/30* (2006.01)
*H05B 3/46* (2006.01)

(52) U.S. Cl.
CPC ..... *A24F 1/30* (2013.01); *H05B 3/46* (2013.01); *H05B 2203/022* (2013.01)

(58) Field of Classification Search
None
See application file for complete search history.

(56) References Cited

U.S. PATENT DOCUMENTS

D254,930 S 5/1980 Mandon et al.
D404,459 S 1/1999 Furner et al.
D641,464 S 7/2011 De Haan et al.
D698,434 S 1/2014 Wolff
D722,720 S 2/2015 Garbo
D731,465 S 6/2015 Khubani
D760,430 S 6/2016 Hanna
D767,820 S 9/2016 Jordan et al.
D770,088 S 10/2016 Abadi et al.
D782,108 S 3/2017 Jordan et al.
D787,439 S 5/2017 Sloan
D818,078 S 5/2018 Zhang et al.
D841,231 S 2/2019 Hawes et al.
D853,547 S 7/2019 Avidor et al.
D861,977 S 10/2019 Masri
(Continued)

FOREIGN PATENT DOCUMENTS

CN 202396428 U 8/2012
CN 206294887 U 7/2017
DE 20212626 U1 10/2002

OTHER PUBLICATIONS

Office Action—Requirement for Restriction/Election on related US application (U.S. Appl. No. 29/645,058) dated Nov. 5, 2019.
(Continued)

*Primary Examiner* — Dennis R Cordray
(74) *Attorney, Agent, or Firm* — Klein, O'Neill & Singh, LLP

(57) ABSTRACT

A hookah device having a heating unit, a head for holding a cooking element, a pipe, and a base. The heating unit for use with the hookah device can be provided with a base and a lid and vents along a bottom wall, a sidewall, and a top wall to facilitate circulation of fresh air and heated air. Surface ornamentations can be provided with the base and the lid.

17 Claims, 12 Drawing Sheets

(56) References Cited

U.S. PATENT DOCUMENTS

| | | | |
|---|---|---|---|
| D870,371 | S | 12/2019 | Storz |
| D873,480 | S | 1/2020 | Hawes et al. |
| 2010/0083973 | A1 | 4/2010 | Zoumut |

OTHER PUBLICATIONS

Office Action—Requirement for Restriction/Election on related US application (U.S. Appl. No. 29/645,062) dated May 20, 2020.
International Search Report and Written Opinion on corresponding PCT application (PCT/US2019/028380) from International Searching Authority (EPO) dated Jul. 18, 2019.

HOOKAHS, HEATING UNITS, AND RELATED METHODS

FIELD OF ART

The present invention relates to a hookah and more particularly to a heating unit for applying heat to a combustible material to generate heat for vaporizing oil essences from a cooking element for inhalation and related methods.

BACKGROUND

Hookahs are popular among many consumers for smoking tobacco. A typical hookah includes a head, a pipe, and a water bowl. The head includes a heating unit and a cooking chamber, the pipe includes a stem, and the bowl includes a reservoir and an inhaling tube. The head rests upon the pipe. In the head, the heating unit couples to the cooking chamber to provide heat from a heat source such as burning charcoal, coal, or some other kind of fuel. The heat generated by the heat source is directed into the cooking chamber where tobacco is deposited. The heat causes the tobacco to emit smoke, such as by vaporizing the oil essences from the tobacco, that can then be enjoyed by a user.

An opening in the cooking chamber connects to the stem of the pipe. The stem has a conduit that extends into a reservoir of liquid stored in the base. The base encloses a reservoir of liquid and an area above the reservoir that provides an air pocket. The smoking tube has an opening into the base that is above the surface level of the reservoir.

To smoke the combustible material, user inhales a mouthpiece connected the smoking tube. The inhalation through the tube draws air from the air pocket creating a partial vacuum in the base. The partial vacuum draws smoke from the cooking chamber into the stem and through the reservoir of liquid into the air pocket. As the user continues to inhale, the smoke is drawn through into the smoking tube where it is inhaled by the user.

To function properly, the combustible material or cooking element in the hookah must be heated to a proper temperature range. The proper temperature range causes the combustible material to generate smoke that has a desired flavor and is of a sufficient amount to smoke to maximize the enjoyment of the user. If too much heat is applied, the combustible material may burn in the cooking chamber. The burning of the combustible material may cause the material to lose the intended flavor, produce undesired gases, and/or produce fine ash that may be inhaled by the user and/or collect in various part of the hookah causing an unwanted mess and/or damage.

SUMMARY

An advance in the art is made by a heating unit for a hookah in accordance with various embodiments of the invention. An exemplary heating unit for a hookah in accordance with some embodiments of the invention can include a base with two different vent types.

A first set of vents on the base allow air flow to be directed into an internal chamber of the base to control the burning of the fuel in the combustion chamber and then heated air to exit the internal chamber of the housing for use to heat a cooking element through a different set of vents. In some examples, a lid can with lid openings or top vents can be placed atop of the base for use with the base. The lid can optionally include a top cover that can act like louvers for controlling one or more top vents incorporated with the lid.

The base can have a base wall defining a combustion chamber, said base wall can comprise surface ornamentations. The base wall of the base can have a wall thickness. A first vent type can form through the base wall of the base. A second vent type can form through the base wall of the base. The first vent type can form through the thickness of the base wall. The second vent type can form through the height of the base wall.

The first vent type can be called a side air vent. The second vent type can be called a thermal vent. There can be at least first vent type and at least one second vent type. In some examples, there can be a plurality of each of the first and second vent types.

Fresh air can enter the combustion chamber via the one or more side air vents.

Hot or heat air or gas can be directed to a cooking chamber via the one or more thermal vents.

In some examples, the base wall of the base can have surface ornamentations.

The lid can have a rim and the rim can have surface ornamentations.

Surface ornamentations described herein can include concave facets, convex facets, projections, and knuckles.

Side air vents described herein can have any number of shapes, including full opening or opening with partial circumference formed through the base wall.

The base wall of the base can have a wall a variable wall thickness defined by the accurate surfaces and knuckles or projections.

The base can comprise at least four spaced apart side air vents and at least four spaced apart thermal vents.

The lid can comprise at least one oblong top vent.

The bottom wall of the base can comprise spaced apart raised projections defining vent grooves therebetween.

The bottom wall of the base can comprise a bypass flow duct. The bypass flow duct can comprise intersecting recessed channels.

The sidewall of the base can comprise interior arcuate surfaces and exterior arcuate surfaces.

The sidewall of the base can comprise interior projections and exterior projections, and wherein a set of interior projection and exterior projection define a knuckle.

Aspects of the present invention can include a hookah device comprising: a heating unit comprising a base having a structure defining a combustion chamber and a lid, the base comprising: a sidewall having a wall, an exterior surface and an interior surface defining a thickness and a wall height; surface ornamentations formed with the exterior surface, the interior surface, or both; wherein said surface ornamentations comprising a projection and an arcuate surface; a bottom wall attached to the sidewall; at least one side air vent formed through the sidewall to expose the combustion chamber to fresh air flow from an exterior; and a thermal vent formed through the sidewall at a location proximate the projection, said thermal vent having a top end opening at a top edge of the sidewall and a bottom end opening at an exterior surface of the bottom wall; and the lid comprising a top wall and a rim, and wherein the rim comprise surface ornamentations comprising a projection and an arcuate surface.

An airflow groove can be provided at an interior surface of the bottom wall of the base.

The top wall of the lid can comprise at least one top vent. A top cover can be include with the lid to control an opening of the at least one top vent.

The surface ornamentations can be formed with both the interior surface and the exterior surface of the base wall of the base.

The surface ornamentations can comprise twelve internal projections, twelve external projections, twelve internal concave facets, and twelve external concave facets.

A pair of internal projection and external projection an define a knuckle and wherein a thermal vent can extend through the sidewall of the base at each knuckle.

The surface ornamentations can comprise ten internal projections, ten external projections, ten internal concave facets, and ten external concave facets.

A handle can extend from a rim of a lid. The handle can extend at a projection of the rim.

A further aspect of the present invention includes a method of manufacturing a hookah. The method can comprise: forming a base comprising a water bowl; placing a pipe having a downstem into the base; attaching a tobacco bowl at an end of the pipe, said tobacco bowl having a first opening having a larger dimension than a second opening; placing a heating into the tobacco bowl at the first opening; said heating unit comprising a base having a structure defining a combustion chamber and a lid, the base comprising: a sidewall having a wall, an exterior surface and an interior surface defining a thickness and a wall height; surface ornamentations formed with the exterior surface, the interior surface, or both; wherein said surface ornamentations comprising a projection and an arcuate surface; a bottom wall attached to the sidewall; at least one side air vent formed through the sidewall to expose the combustion chamber to fresh air flow from an exterior; and a thermal vent formed through the sidewall at a location proximate the projection, said thermal vent having a top end opening at a top edge of the sidewall and a bottom end opening at an exterior surface of the bottom wall; and the lid comprising a top wall and a rim, and wherein the rim comprise surface ornamentations comprising a projection and an arcuate surface.

The method can include placing a heating source into the combustion chamber.

The method can include angularly orienting the lid relative to the base so that ornamentations of the base align with ornamentations of the lid.

A still further aspect of the invention is a heating unit for use with a hookah device comprising a base having a structure defining a combustion chamber and a lid for placement onto of the base, wherein the base comprises at least one side air vent and at least one thermal vent.

The base and the heating unit can have one or more features described elsewhere herein and wherein the base with one or more features described elsewhere herein can be placed atop a tobacco bowl of a hookah device.

The lid can have a plurality of spaced apart air vents. The plurality of air vents can have different sizes, such as different lengths.

A still further aspect of the present invention is a heating unit for use with a hookah device comprising a base having a structure defining a combustion chamber and a lid for placement onto of the base; wherein the base comprises: a sidewall having a wall, an exterior surface and an interior surface defining a thickness and a wall height; surface ornamentations formed with the exterior surface, the interior surface, or both; wherein said surface ornamentations comprising a projection and an arcuate surface; a bottom wall attached to the sidewall; at least one side air vent formed through the sidewall to expose the combustion chamber to fresh air flow from an exterior; and a thermal vent formed through the sidewall at a location proximate the projection, said thermal vent having a top end opening at a top edge of the sidewall and a bottom end opening at an exterior surface of the bottom wall; and wherein the lid comprises: a top wall having at least one top vent; and a rim depending from the top wall; and wherein the rim comprise surface ornamentations comprising a projection and an arcuate surface.

Methods of making and methods of using the hookah device and components thereof are within the scope of the present invention.

BRIEF DESCRIPTION OF THE FIGURES

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of a hookah and components thereof provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
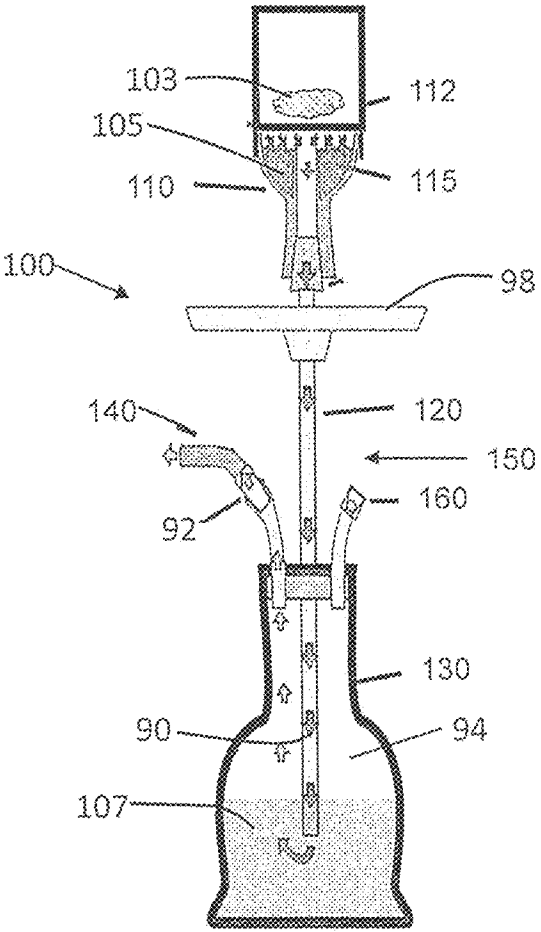
FIG. 1 is a side view of a hookah with a heating unit in accordance with an embodiment of the invention.

A hookah device or hookah with its many components are described. Also described are different embodiments of a heating unit for use with a hookah. Each heating unit is sized and shaped to accommodate a heating source to provide heat to a cooking element in the hookah to cook or heat the cooking element, which can be tobacco, herbs, floral essences, etc., to extract oil essences therefrom for inhalation. In accordance with many embodiments of the invention, the heating unit can include a plurality of vents and different number of vents for air flow and hot gas flow to heat the cooking element to cook or heat the combustible material. An exemplary schematic view of a hookah 100 including a heating unit 112 in accordance with an embodiment of the invention is shown in FIG. 1.

As shown, the hookah 100 includes a head 110, also called a tobacco bowl, a pipe 150, and a base 130, which is also understood in the industry as a water jar or water bowl. The head or tobacco bowl 110 is affixed to a top of the pipe 150 and the head 110 can comprise a structure defining a cooking chamber 105 for containing a quantity of a cooking element or shisha 115, such as tobacco, herbal leaves or other materials to be vaporized by heat to extract oil essences therefrom.

A heat management accessory unit 112 is positioned superjacent or above the head or bowl 110 and the cooking element 115. A catch tray 98 can be located below the bowl 110 and the heat management unit 112 to collect particulates or ashes emanating from the heat management accessory unit 112 and/or the bowl 110. The heat management accessory unit 112 is structured to receive combustible materials 103 to then heat intake air, which is then routed by flow channels to heat the cooking element 115 in the bowl 110 to vaporize oil essences therefrom for inhalation. The heat management accessory unit 112 may herein alternatively be referred to as a heating unit or heat management unit 112.

The generated heat from the heating unit 112 is applied, such as routed by one or more ducts, ports, channels, or passages to the cooking element 115. For example, the generated heat can pass over, across, and/or through the cooking element 115 to vaporize oil essences from the cooking element, which can be changed out, replenished or replaced from time-to-time as needed. The cooking element 115 can be placed into the cooking chamber 105 of the head 110 by lifting the heating unit 112 to expose the opening to the cooking chamber, which can optionally contain a fine mesh for retaining the cooking element 115 and preventing the cooking element from dislodging further down the pipe 150.

Heated air from the heating unit 112 can be circulated to the cooking element 115 inside the cooking chamber 105 of the head 110 to generate smoke, which then passes through a downstem 90 located in the base 130 under column of liquid 107, such as a water column, for cooling and filtering the smoke before the smoke is routed through a hose port, hose, and then mouthpiece attached to the house for inhalation by a user using the mouthpiece.

With further reference to FIG. 1, the pipe 150 includes a stem 120 and a portion of the stem, called a downstem 90, located inside the base 130 with the opening of the downstem 90 located under the column of water or liquid 107. The height of the water level above the downstem opening can be adjusted by adding water to the base 130 to control the volume of water or liquid above the opening of the downstem for cooling and filtering the heated smoke discharging out the downstem. A hose port 92 is provided with the hookah and the opening to the hose port 92 is in fluid communication with the vapor chamber 94 of the base 130 above the liquid level so that cooled and filtered smoke percolating through the water column can be directed through the hose port 92.

In some examples, there can be more than one hose port in fluid communication with the vapor chamber 94, such as two, three, or four hose ports. The additional hose ports can be connected to additional hoses and mouthpieces so that more than one user can use the same hookah. A hose 140 can connect to the hose port 92 and a mouthpiece can be attached to the other end of the hose 140 for use by a user to inhale the cooled and filtered smoke.

The base 130 can embody any number of shapes and can be made from blown glass, porcelain or other materials. The base 130 has an internal space that encloses a reservoir of liquid and provides an area above the reservoir, i.e., the vapor chamber 94, to contain smoke or air exiting a downstem and percolating through the liquid. In accordance with the shown embodiment, the liquid in the reservoir is water. However, other types of liquids may be used in accordance with various other embodiments of the invention, such as wine, soda, beer, etc.

To inhale smoke, the user can first prepare the hookah, if not already prepared, with a desired quantity of cooking element 115 in the cooking chamber of the head or bowl 110. The user then adds fuel 103 to the heating unit 112, which can be in the form of wood, coal or charcoal, or other conventional fuel sources for use with hookahs. After a short heat up time, the user can begin to inhale on the mouthpiece at an end of the hose 140 to draw air from the vapor chamber 94 creating a partial vacuum in the enclosed area. The partial vacuum causes air or smoke to be drawn into pipe 150 from the cooking element 115 through the liquid in the reservoir of the base 130 and into the vapor chamber 94. As the user continues to inhale from the mouthpiece at the end of the hose 140, smoke in the vapor chamber 94 is sucked through the hose port 92 and the hose 140 and then inhaled by the user. To clear the base 130 of smoke, the base 130 may include a purge valve 160 that may be opened to release the partial vacuum and let air escape from within the base 130.

The hookah device 100 described with reference to FIG. 1 is exemplary only as hookah devices having other configurations in accordance with various other embodiments of the invention are possible and usable with heating unit 112 of the present invention. Thus, the heating unit 112 described herein are understood to be usable with any number of hookah devices that require a heat source for heating intake air to heat a cooking element.

Figure 2:
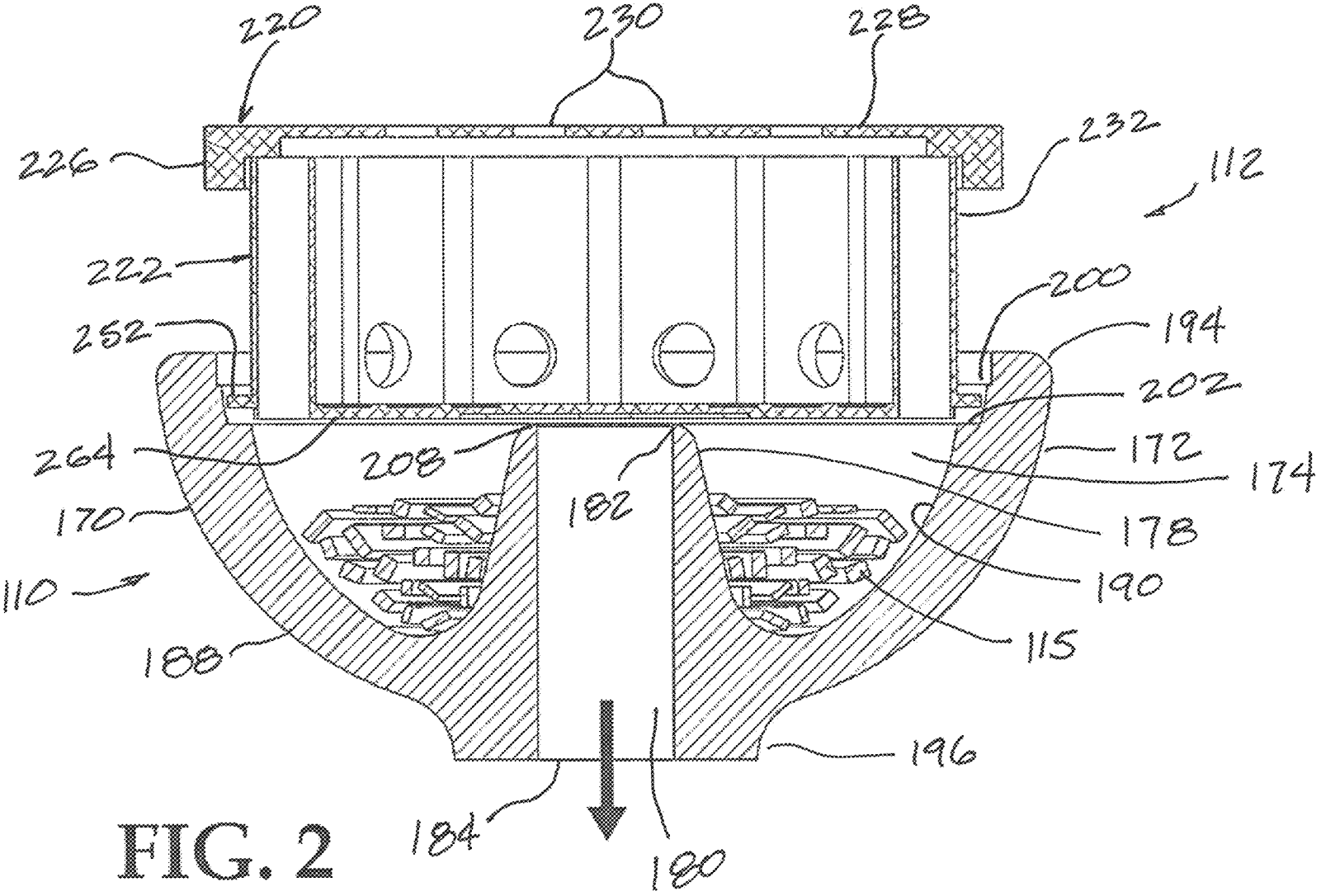
FIG. 2 is side cross-sectional view of a tobacco bowl or head and a heating unit seated without the bowl shown without other components of a hookah.

Referring now to FIG. 2, an enlarged schematic view of a heat management unit 112 mounted on top of a tobacco bowl or head 110 is shown, shown without other parts or components of a typical hookah. As shown, the head or bowl 110 comprises a body 170 having a bowl shape wall 172 defining a receiving space 174 for receiving a cooking element or shisha 115, which can be tobacco, herbal leaves, or other oil essences. The body 170 comprises a central column 178 having a wall surface defining a bore or passage 180 that is in fluid communication with the passage of the pipe 150 (FIG. 1). The central column 178 has a first open end 182 and a second open end 184, which can define two end openings to the passage 180 of the central column 178. The second open end 184 can be sized and shaped to couple to a pipe 150, either directly or with a coupling, nipple or fitting. The first end 182 can be sized and shaped to direct vaporized oil essences to flow therethrough into the passage 180 and into the pipe 150 (FIG. 1). Optionally, the first end 182 can contact and support the heating unit 112, as further discussed below.

The wall 172 of the body 170 has an exterior surface 188 and an interior surface defining the receiving space 174. The bowl shape body 170 has an enlarged first end or upper end 194, which is larger in diameter than a second end or bottom end 196. A ledge 200 with a support shoulder 202 is provided on the interior surface 190 at the first end 194 of the body. The ledge 200 is sized and shaped to receive an end of a heating unit 112, which can rest on the support shoulder 202 of the ledge. The ledge 200 can have different inside diameters, or a variable inside diameter, to facilitate placement of the heating unit into the first end 194 of the body 170 of the head 110.

In an example, the first open end 182 of the central column 178 has an end surface 208 that is registered, elevation-wise, with the support shoulder 202 so that a plane is defined by the registered surfaces. Thus, the heating unit 112 can simultaneously rest on the support surface 202 and the end surface 208 of the central column 178. In other examples, the surfaces of the body 170 of the head 110 are not registered so that a base flange 252 on the heating unit 112 rests on the support shoulder 202 but the base bottom 264 does not rest on the end surface 208 of the central column 178. Alternatively and as shown, the base bottom 264 of the heating unit 112 can rest on the end surface 208 of the central column 178 while the base flange 252, which as a rim 212 (FIG. 3), can be spaced from the support shoulder 202. Said differently, if the support shoulder 202 defines a referenced plane, the end surface 208 of the central column 178 can project above the referenced plane, can locate at the referenced plane, or can recess below the referenced plane, elevation-wise. Under any scenario, a flow passage can be provided between the receiving space 174 and the bore or passage 180 of the central column 178 to permit vaporized essences to be directed down the pipe 150 (FIG. 1) when drawn by a user.

In an example, the head or tobacco bowl 110 can be made from a conventional material, such as porcelain, ceramic, blown glass, or metal.

The heating unit 112 is shown with a lid 220 positioned or located onto a base or housing 222. The heating unit 112 can be sized and shaped to operate with any number of hookahs. In an example, the lid 220 can have a rim 226 depending from a top wall 228, which can have a plurality of top vents 230. The rim 226 can be sized and shaped to seat around the exterior 232 of the base 222. However, it is envisioned that other fitment types or styles can be incorporated. For example, the housing 222 can include projections or extended columns that fit around the outside of the rim 226 of the lid or the rim can be situated in-line atop the sidewall of the housing 222. Further aspects of the heating unit 112, and specifically the lid 220 and base 222, are further discussed below.

Figure 3:
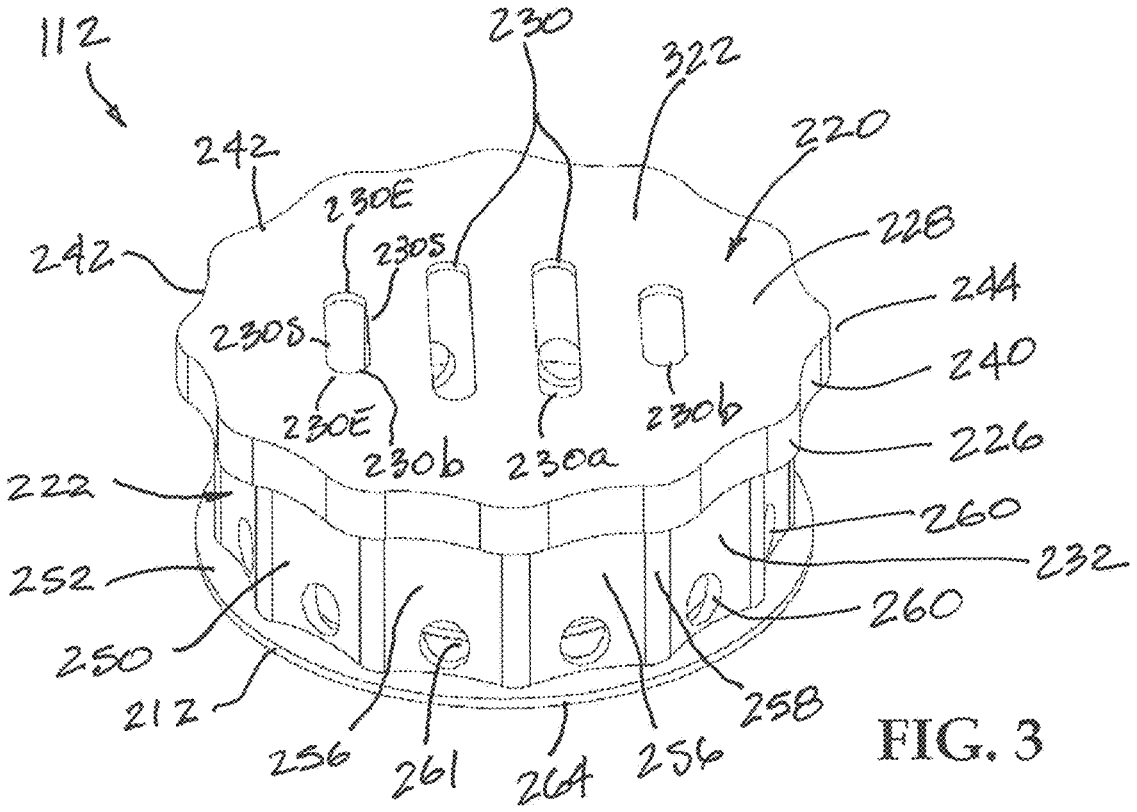
FIG. 3 a top perspective view of a heating unit in accordance with aspects of the present invention.

With reference now to FIG. 3, a perspective view of the heating unit 112 of FIG. 2 is shown without the head 110. As shown, the lid 220 has a plurality of spaced apart top vents 230 having generally oblong or elongated oval openings. In the example shown, four top vents are provided with two of the four top vents being longer than the remaining two top vents. In a particular example, the two longer elongated oval openings 230*a* are more centrally located than the two shorter elongated oval openings 230*b*. For example, the two longer elongated oval openings 230*a* can be located between the two shorter elongated oval openings 230*b*. In other example, a single longer elongated oval opening 230*a* is located between two shorter elongated oval openings 230*b*. In still other examples, one or more shorter elongated oval openings 230*b* can be located between two longer elongated oval openings 230*a*.

Each vent opening of the top vents 230 can have two side edges 230S and two end edges 230E and wherein the side edges 230S of the four vent openings 230*a*, 230*b* are generally parallel to one another. Each oblong vent can have two ends each with a half-circle shape or configuration. In other examples, the top vents 230 can have shapes that are other than oblong or elongated oval shape and the side edges 230S do not have to be parallel. For example, the openings can be round, triangular, polynomial, star shape, or irregular. The top vents 230 can also be evenly located on the top wall 228 or randomly located. The individual top vents can be dispersed along the top wall 288 to facilitate fresh air flowing into the combustion chamber inside the heating unit 112 and/or exhaust as flowing out of the combustion chamber to dissipate heat.

Each top vent can have a width that is about 0.16 to about 0.25 inch wide. Each longer elongated oval opening 230*a* can have an overall length of about 1 inch to about 1.5 inches. Each shorter oval opening 230*b* can have an overall length of about 0.5 to about 0.8 inch. The provided dimensions are exemplary only as the dimensions of the top vents can vary without deviating from the scope of the invention.

In some examples, the lid 220 can be provided with a lid cover that can act to control the size of the openings of the top vents 230 and therefore act as louvers for the top vents. For example, the top wall 228 of the lid 220 can be provided with a central boss or opening and a cover lid with a pin can project into the central boss and rotatable about the boss via the pin. Rotation of the cover lid, which can have a plurality of spaced openings mixed with solid surfaces, relative to the top wall 228 can cause the cover lid to partially or completely cover the top vents 230 to thereby completely close the top vents 230, completely open the top vents 230, or vary the size of the top vents to somewhere in between to control the size of the vent openings. This can then control the amount of hot gas that flows directly out of the top vents 230 or the amount of fresh air that enters the combustion chamber versus the amount that is directed through the thermal vents to heat the cooking element, as further discussed below.

In an example, the lid 220 can be made from aluminum with the option to anodize. However, the lid 220 may be made from many other materials including, but not limited to, metals, alloys and/or ceramics that can withstand high operating temperatures in accordance with some other embodiments of the invention. The lid 220 can have an outer perimeter 240. In an example, the outer perimeter 240 can have a plurality of concave facets 242 with two adjacent concave facets 242 joined by a projection or an apex 244. Each concave facet 242 can have a surface that is inwardly defined, such as having an inward arc or inward arcuate surface when viewed along a top or plan view. Generally speaking, the surface features at the rim can comprise arcuate surfaces.

In the embodiment of FIG. 3, twelve concave facets 242 and twelve projections 244 are provided along the outer perimeter 240 of the lid 220. Said differently, the lid comprises surface ornamentations, which can comprise arcuate surfaces. In other examples, the number can be fewer than twelve or greater than twelve. For example, there can be eight concave facets 242 and eight projections 244 or sixteen concave facets 242 and sixteen projections 244. In still other examples, the outer perimeter 240 can have a reversed shape, where the current projections 244 are more rounded and the current concave facets 242 more acute. In yet other examples, the outer perimeter 240 can be generally round without any surface ornamentations.

In an example, the base 222 comprises a base wall 250, or sidewall of the base 222, and a base bottom 264 having a base flange 252. Like the rim 226 of the lid 220, the base wall 250 can comprise an outer or exterior surface 232 having a plurality of concave facets 256 with two adjacent concave facets 256 joined by a projection or an apex 258. Each concave facet 256 can have a surface that is inwardly defined, such as having an inward arc or inward arcuate surface when viewed along a top or plan view. Said differently, the base 222 comprises surface ornamentations, which can comprise arcuate surfaces.

In the embodiment of FIG. 3, twelve concave facets 256 and twelve projections 258 are provided along the outer surface 232 of the base wall 250. In other examples, the number can be fewer than twelve or greater than twelve. For example, there can be eight concave facets 256 and eight projections 258 or sixteen concave facets 256 and sixteen projections 258. In still other examples, the outer surface 232 can have a reversed shape, where the current projections 258 are more rounded and the current concave facets 256 more acute. In yet other examples, the outer surface 232 of the base wall or sidewall 250 can be generally round without any surface ornamentations.

Preferably, the outer perimeter 240 of the rim 226 and the outer surface 232 of the base wall 250 of the base 222 have the same ornamentations, such as having the same number of concave facets and projections so that when the lid 220 is located over the base 222, the projections 244 on the lid align with the projections 258 on the base and the concave facets 242 on the lid align with the concave facets 256 on the base. However, as further discussed below, the lid 220 can rotate relative to the base 222 and the surface ornamentations of the two do not have to align.

In an example, each concave facet 256 of the base 222 incorporates a side air vent 260. Thus, if the base 222 has twelve concave facets 256, then the base can have twelve side air vents 260. Each side air vent 260 can be located at a mid-point or center position between two side edges of each concave facet 256. The concave facets 256 can be equally sized. The side air vents 260 can be equally spaced from one another. In alternative embodiments, the side air vents are not equally spaced from one another.

If the base wall 250 has a height measured between a top end and a bottom end near the base flange 252 of the base wall 250, the side air vents 260 are preferably located closer to the bottom end than the top end of the base wall. However, the side air vents 260 can be positioned elsewhere along the height of the base wall. In an example, the edge of each side air vent 260 is roughly 2-8 mm from the bottom end. Still further, part of each air vent 260 can be open at the bottom end of the base wall 250, or sidewall of the base, such as by embodying a half-circle, half square, half-oval, half-rectangle, etc., with part of the circumference of the side air vent formed by the base bottom 264. Improved air/fuel mixing has been found when the side air vents 260 are incorporated closer to the bottom end of the base wall 250 than when moved closer to the top end of the base wall.

In alternative embodiments, there can be fewer side air vents 260 than the number of concave facets 256. For example, there can be fewer than twelve air vents 260 for a base 222 having twelve concave facets 256. In still other examples, there can be more air vents 260 than the number of concave facets 256. For example, one or more of the concave facets 256 can have two or more side air vents 260.

As shown, each side air vent 260 has a perimeter defining a round opening. For a base 222 having a diameter of about 2.2 inches to about 2.6 inches, each side air vent opening can range from about 0.17 to about 0.25 inch. However, in other examples, the diameter of the base and the opening size of each side air vent, the opening shape, and the number of side air vent openings can vary. For example, each concave facet 256 can have two openings, one above the other, and each set of two can have a relatively smaller opening size than the single opening size shown in FIG. 3. In use, fresh air can be directed into the side air vents 260 and into the combustion chamber of the heating unit 112 for use by a fuel source inside the combustion chamber. Air can be drawn into the combustion chamber due to the pressure differential between the ambient condition and the combustion chamber.

Figure 5:
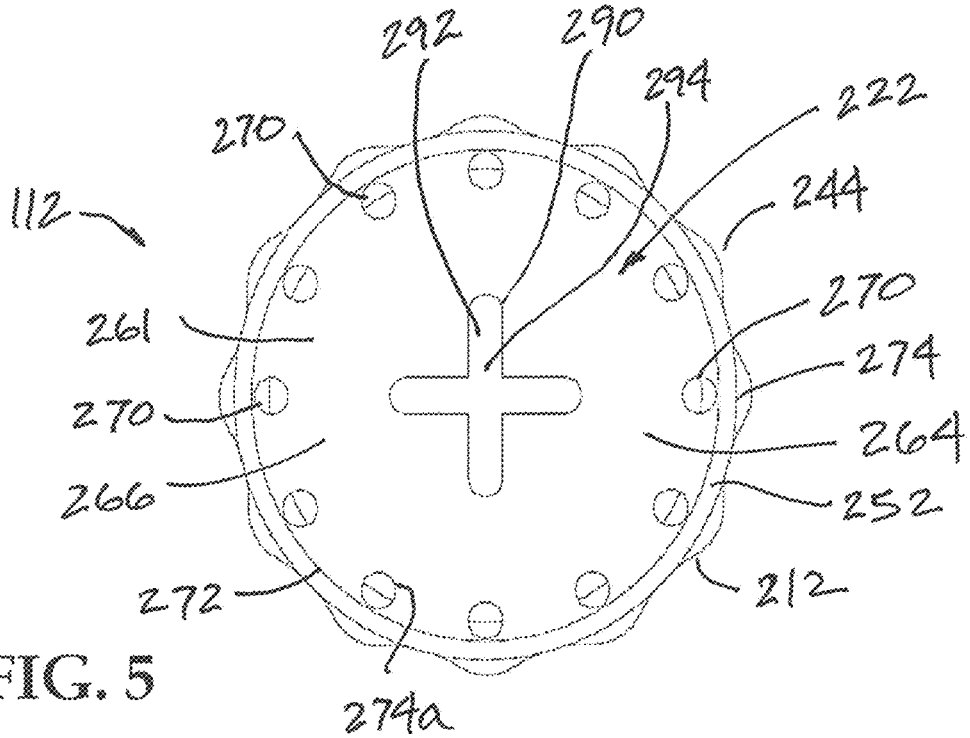
FIG. 5 is a bottom plan view of the heating unit of FIG. 3, showing the base.

The base bottom 264 of the base 222 can be viewed as a wall 261 with a thickness and having an extended portion defining the base flange 252. The wall 261 can have an interior facing surface 310 (FIG. 6), which forms a bottom of the combustion chamber 278, and an exterior surface 266 (FIG. 5). The base flange 252 can have a wall structure with a rim 212 that is generally round. The outside diameter of the base flange 252 can be larger than the largest outside dimension of the base wall 250 so that part of the base flange 252 extends radially outwardly of the exterior 232 of the base wall 250 along the entire circumference of the base wall.

With reference to FIG. 2 and further reference to FIG. 3, the base flange 252 can be sized and shaped to act as a centering device when placed inside the annular space defined by the open end 194 of the head 110 (FIG. 2) and/or a support platform to support the entire heating unit 112 if rests against the support shoulder 202 within the head 110.

Figure 4:
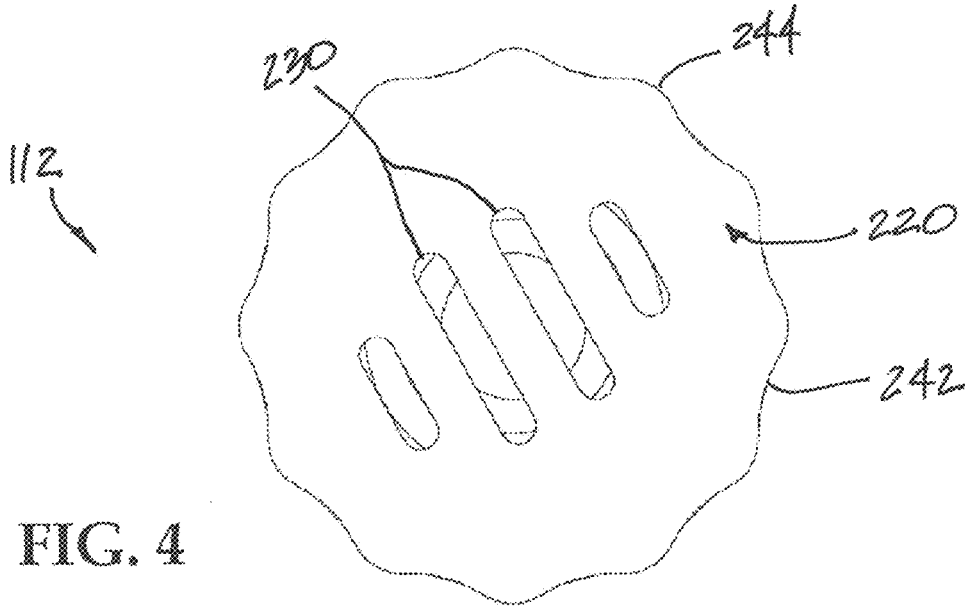
FIG. 4 is a top plan view of the heating unit of FIG. 3, showing the lid.

FIG. 4 is a top view of the heating unit 112 of FIG. 3, looking at the lid 220. FIG. 5 is a bottom view of the heating unit 112 looking up at the exterior surface 266 of the base bottom 264.

As shown in FIG. 5, the plurality of projections 244 of the lid 220 can be seen extending further radially of the outer diameter of the rim 212 of the base flange 252. Also shown in FIG. 5 is the base bottom 264 having a wall 261 with an exterior surface 266 defining a bottom plane and a base flange 252, which is recessed from the exterior surface 266 of the base flange 252, as shown in FIG. 2. A shoulder or lip 274 (FIG. 6A) is provided between the base flange 252 and the exterior surface 266. The base bottom 264 has an outside diameter (OD) 272 at the exterior surface 266.

In an example, a plurality of thermal vents 270 are provided through the base bottom 264 so that a plurality of bottom end openings 274*a* are exposed at the bottom exterior surface 266. In the example shown, twelve thermal vents 270 with twelve end openings 274 are provided at the base bottom 264. More particularly, twelve thermal vents 270 are provided with passages that extend through the base wall 250 of the base 222 at the twelve projections 258 so that twelve bottom end openings 274*a* are provided at the exterior surface 266 of the base bottom 264 and twelve top end openings 274*b* are provided at the top edge 280 (FIG. 6) of the base wall 250.

A bypass flow duct 290 in the form of a recessed channel 292 is provided on the wall 261 of the base bottom 264, at the exterior surface 266. In the embodiment shown, the recessed channel 292 has a cross-shape or plus-shape pattern with other shapes contemplated. The recessed channel 292 has a recessed surface 294 that is off-set from the exterior surface 266 of the base bottom 264. Thus, when the base 222 is placed on top of the central column 178 of the head 110

(FIG. 2), the contact between the end surface 208 of the central column 178 and the base bottom 264 of the base 222 does not obstruct, block-off, or seal-off the bypass flow duct 290 of the base 222. Vapor or gas from the receiving space 174 of the head or tobacco bowl 110 can therefore flow into the bypass flow duct 290 and into the bore 180 of the head for inhaling by a user, as further discussed below.

Figure 6:
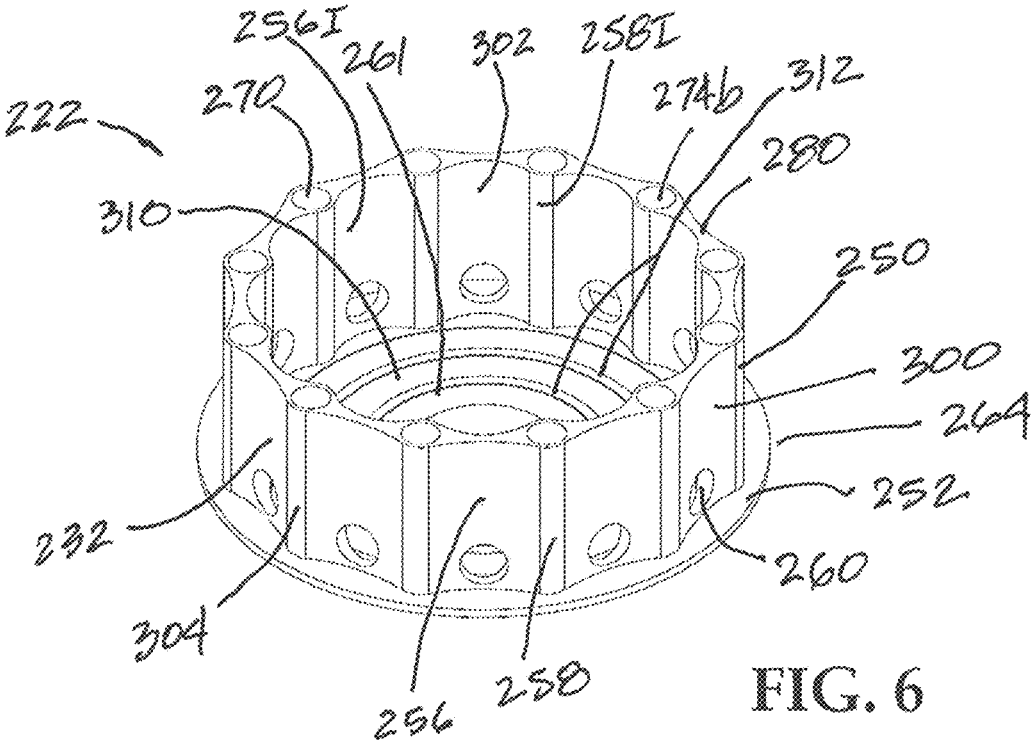
FIG. 6 is a perspective view of the base of FIG. 3, shown with the lid.

With reference now to FIG. 6, a perspective view of the base 222 is shown without a lid. As shown, the base wall 250 is mounted above the base bottom 264. A combustion chamber 278 is provided inside the walls defined by the base wall 250 and the base bottom 264. Combustible material such as wood, coal, or charcoal, may be placed in the combustion chamber 278 for heating the cooking element located inside the head 110 (FIGS. 1 and 2). In an example, the base 222 is formed as a unitary unit from casting, such as with an aluminum material or an aluminum alloy. The base can optionally be anodized using known processes to increase resistance to corrosion and wear. However, the base 222 may be made from many other materials including, but not limited to, metals, alloys, and/or ceramics that can withstand high operating temperatures in accordance with some other embodiments of the invention.

As shown, the base wall 250 has a wall structure 300 with an exterior surface 232 and an interior surface 302. The wall structure 300 has a wall thickness defined by the exterior surface 232 and the interior surface 302. As the exterior surface 232 of the wall structure 300 comprises a plurality of concave facets 256 and projections 258, the wall thickness is not constant and varies along the circumference of the wall structure. As shown, the interior surface 302 is provided with a similar undulating surface as the exterior surface 232. In other words, the interior surface 302 also has a plurality of concave facets 256I and projections 258I that are mirror images of the exterior surface. However, in other examples, the interior surface 302 can have a single interior diameter defined by a circular surface drawn tangent to the internal projections 258I and similar to the rim of the lid shown in FIG. 9.

As shown, the wall thickness is greatest or widest at a location between an external projection 258 and an internal projection 258I, or between an external projection 258 and the interior surface 302 if the latter is round or circular. The wall is at its thinnest at a location between the centers of two back-to-back concave facets 258, 258I. In still other examples, the wall structure 300 has a constant inside diameter and a constant outside diameter. Where the wall is greatest at the two back-to-back projections 258, 258I, a knuckle or wall joint 304 is defined. Said differently, the base wall 250 of the base 222 incorporates a plurality of arcuate surfaces 256 separated by knuckles 304

In the example shown, a thermal vent 270 is formed through the wall structure 300 at each of the wall joints or knuckles 304. As the present base 222 comprises twelve wall joints 304, there are twelve thermal vents 270 extending through the wall thickness of the wall structure 300. In other examples, there can be fewer thermal vents 270 than there are wall joints 304. Each thermal vent 270 has two end openings, which include a bottom end opening 274*a* (FIG. 5) and a top end opening 274*b*. Each thermal vent 270 has a generally vertical passage or path that runs generally parallel to the height of the wall structure 300. Thus, a gas flow, gas stream or air flow that enters through the top end opening 274*b* of a thermal vent 270 can exit travel along the passage and exit through the bottom end opening 274*a* of the thermal vent.

As shown, the side air vents 260 are staggered relative to the thermal vents 270 so that their openings or passages do not intersect. This arrangement allows fresh air to enter into the combustion chamber 278 from an exterior environment and for hot air or heated gas from the combustion chamber 278 to rise towards the lid 220 (FIG. 2) and then deflected down the plurality of thermal vents 270 and into the receiving space 174 of the head 110 (FIG. 2).

The interior surface 310 of the wall 261 of the base bottom 264 comprises a plurality of raised projections 312. In the embodiment shown, the raised projections embody a series of spaced annular projections or rings 312. In an example, three annular rings 312 are provided. However, two annular rings or more than three annular rings 312 can be incorporated with the interior surface 310. The annular rings 312 define trenches or grooves in the bottom interior surface 310 of the wall 261 that allow air to flow under the fuel in the combustion chamber 278 to facilitate combustion of the fuel, such as coal or charcoal. In the shown embodiment, the annular rings 312 are concentrically positioned in the bottom interior surface of the wall 261. However, the bottom interior surface may have any number of trenches that are in any configuration, including randomly placed crevices or trenches, in accordance with various other embodiments. Furthermore, ventilation at the wall 261 of the base bottom 264 of the combustion chamber 278 may be provided in other manners in accordance with some other embodiments, including, but not limited to, a raised platform with a perforated surface, a grill placed over the bottom interior surface, and a jagged surface.

Figure 6A:
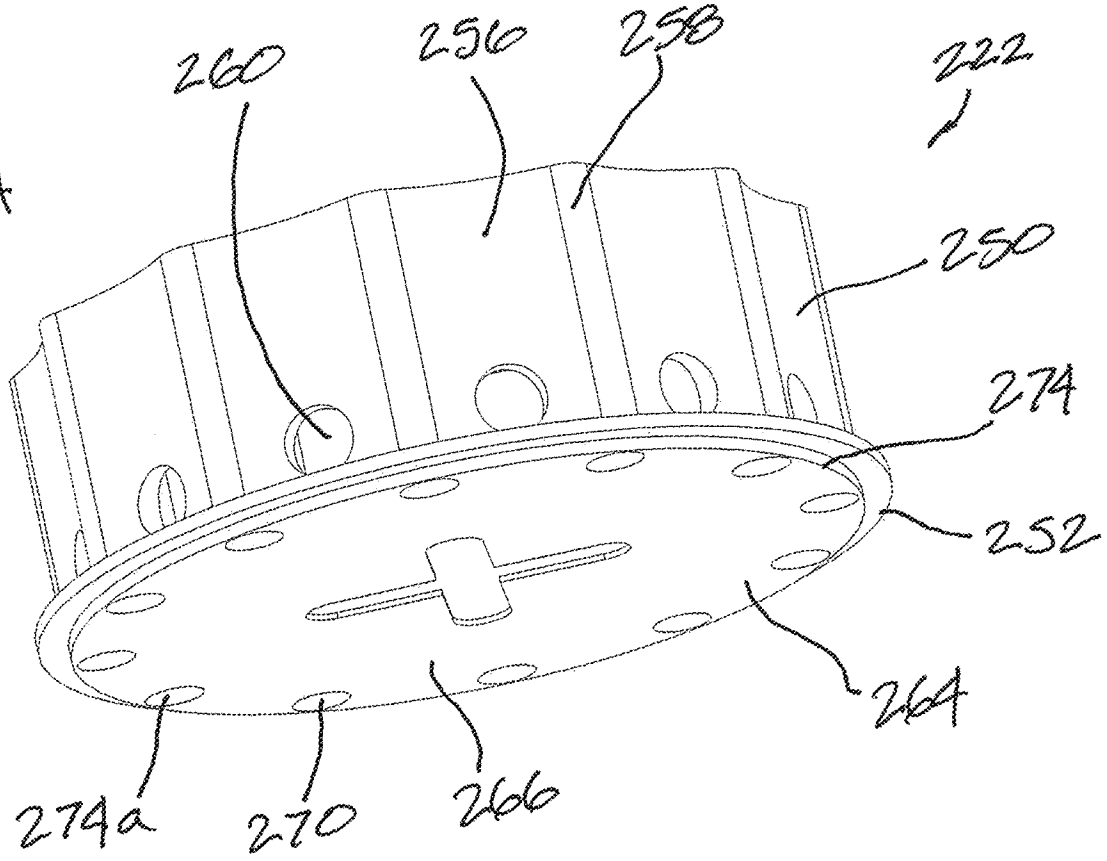
FIG. 6A is a perspective view of the base of FIG. 6, from another viewing angle.

FIG. 6A shows a perspective view of the base 222 from another viewing angle, which more clearly shows the exterior surface 266 of the base bottom 264 and the plurality of bottom vent openings 274*a* of the plurality of thermal vents 270. Also clearly shown from the present viewing perspective is the location of the base flange 252 relative to the exterior surface 266 and the lip or shoulder 274 between the base flange 252 and the exterior surface.

Figure 7:
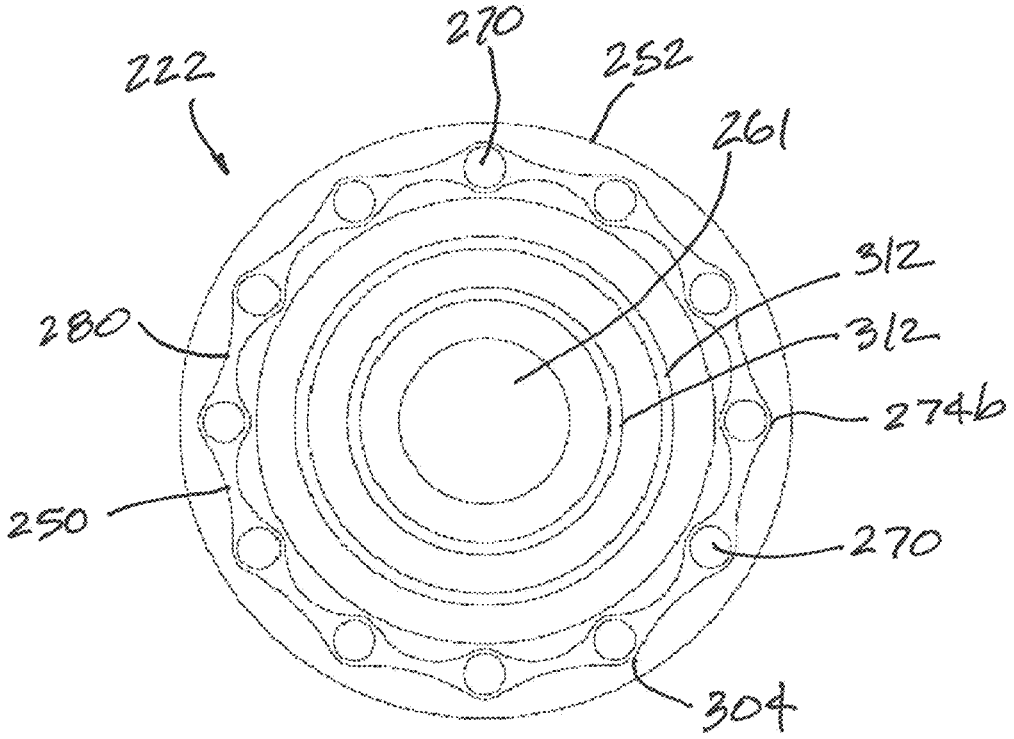
FIG. 7 is top plan view of the base of FIG. 6.

FIG. 7 is a top plan view of the base 222, looking down at the wall 261 and the top edge 280 of the base wall 250.

Figure 8:
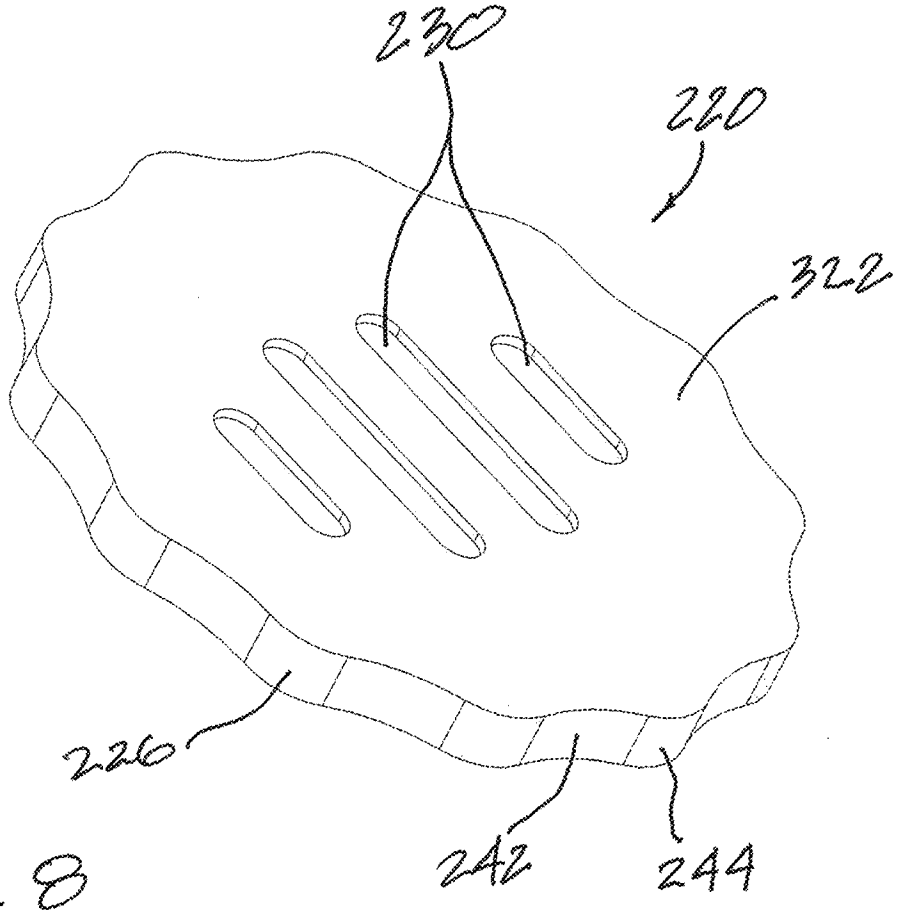
FIG. 8 is a perspective view of a lid in accordance with aspects of the present invention.
Figure 9:
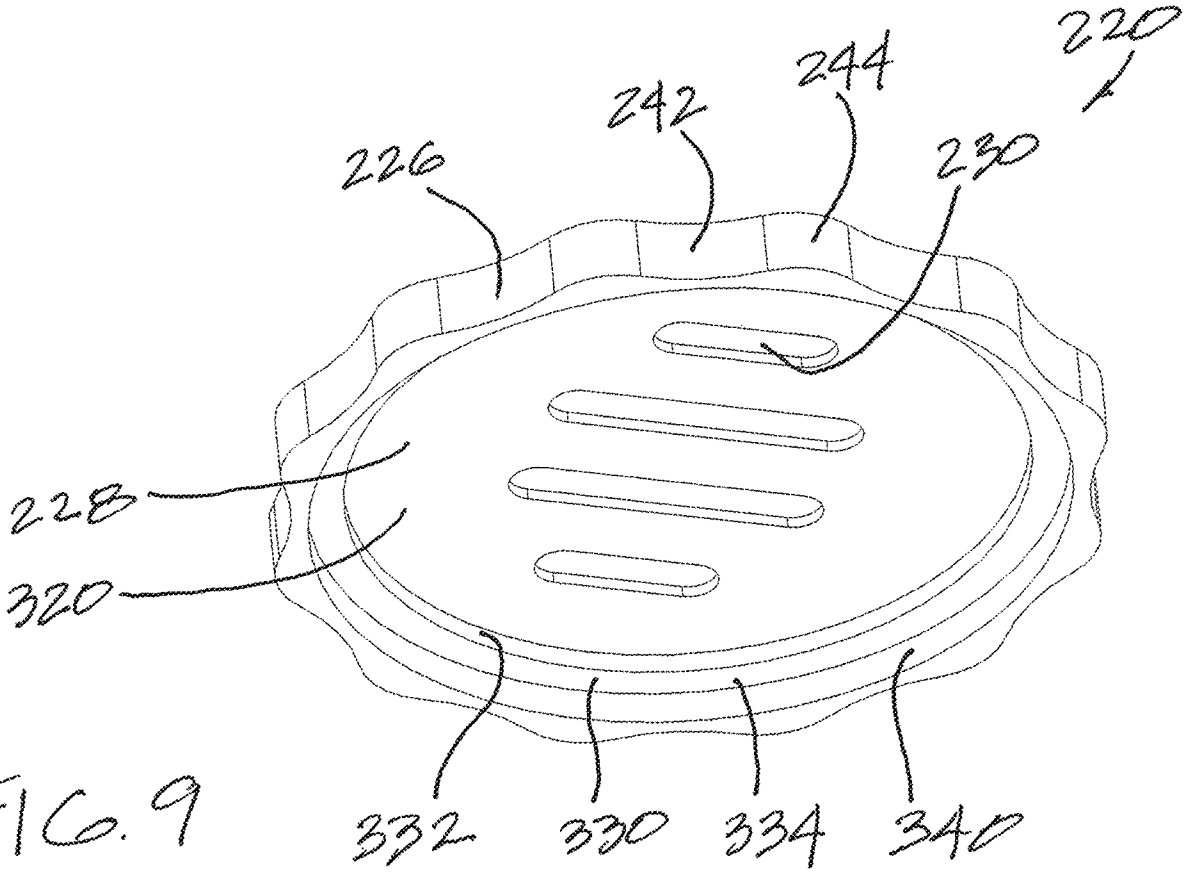
FIG. 9 is a bottom perspective view of the lid of FIG. 8.

FIG. 8 is a perspective view of the lid 220 shown in FIGS. 2 and 3. FIG. 9 is a perspective view of the lid 220 shown from another viewing angle or perspective. With reference to FIGS. 8 and 9 in combination with FIGS. 3 and 7, the lid 220 has a top wall 228 with a plurality of top vents 230 and a rim 226 with surface ornamentations, such as concave facets 242 and projections 244, as previously described. The top wall 228 has an inner surface 320 and an exterior surface 322, which is understood to be referenced relative to the combustion chamber. As shown, a ledge 330 is incorporated between the inner surface 320 and the rim 226. The ledge 330 comprises a step comprising a rise surface 332 and a land surface 334 defining a raised surface that is offset from the inner surface 320. In an example, the ledge 330 embodies a complete or continuous circumference.

In use when the lid 220 is placed over the base 222, the raised surface 334 seats atop the top edge 280 of the base wall 250. The rise surface 332 provides clearance between the inner surface 320 of the lid 220 and the top edge 280 of the base 222 so as not to block the top end openings 274*b* of the plurality of thermal vents 270. The land surface 334 has a width that does not completely block the top end openings 274*b* of the plurality of thermal vents 270. In alternative embodiments, the ledge 330 is notched so that it is not a complete or continuous circumference to provide additional flow paths through the notches for heated gas to flow towards the thermal vents 270.

The inner side surface 340 of the rim 226 is generally smooth and defines a generally round or annular circumference having an inside diameter. In an example, the inside diameter of the inside side surface 340 is larger than the maximum outside circumference dimension of the base wall 250 of the base 222, at least at a location of the base proximate the top edge 280 of the side wall 250. This allows the rim 226 to receive the upper end of the base wall 250 of the base when the lid 220 is placed over the base, and the inside side surface 340 positioned around the upper end of the sidewall, as shown in FIGS. 2 and 3 and further discussed below.

As the inside side surface 340 of the rim 226 is smooth, the lid 220 can be place on top of the base 222 and be oriented in any number of angular positions relative to the base without being dependent on the concave facets 256 and projections 258 of the base 222. However, to provide a uniform alignment between the surface ornamentations of the rim 226 and of the base wall 250 of the base, alignment means may be incorporated to align the concave facets and projections of the lid 220 and the base 222. For example, the ledge 330 of the lid 220 may incorporate one of a tab or a notch and the top edge 280 of the base 222 may incorporate the other one of the tab or the notch so that the two can engage or mate to a desired alignment when the lid is placed over the base.

Figure 10:
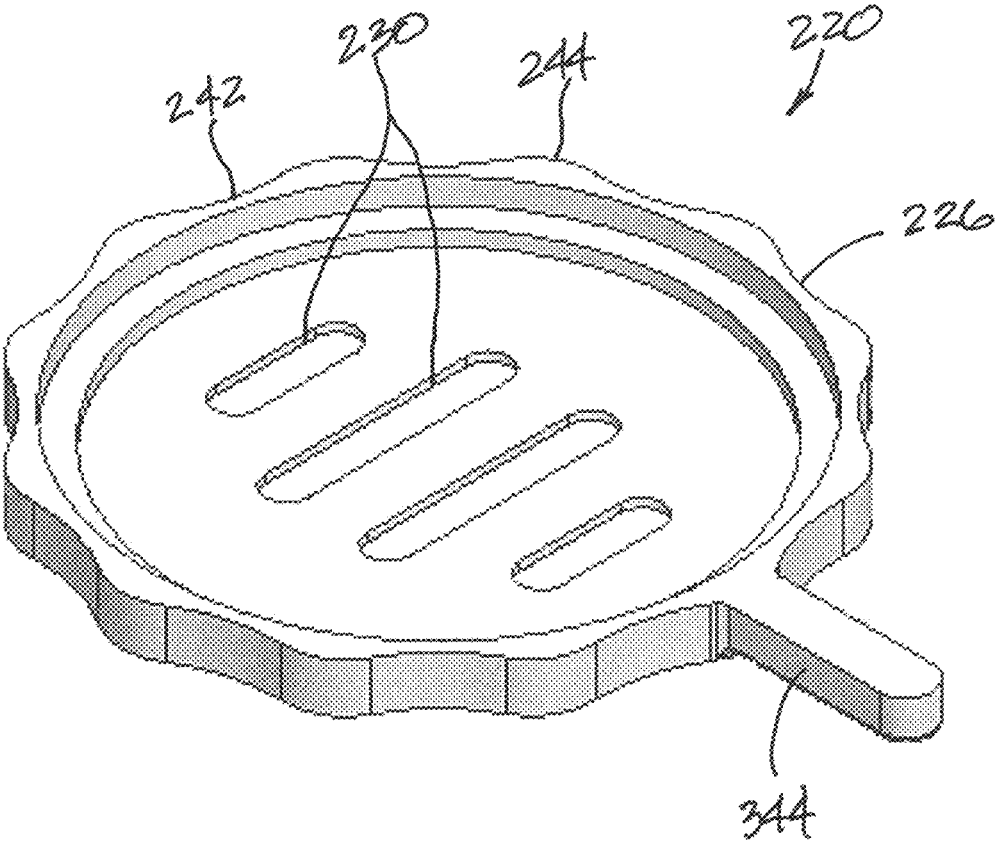
FIG. 10 a perspective view of a lid in accordance to further aspects of the present invention.

FIG. 10 is a perspective view of a lid 220 provided in accordance to further aspects of the present invention. The present lid 220 can be similar to other lids described elsewhere herein but further incorporates a handle 344. The handle 344 can be unitarily formed with the lid or separately formed and subsequently attached to the lid, such as by welding, brazing, or bonding. In an example, the handle 344 can extend radially from an outside surface of the rim 226. As shown, the handle can extend from an outside surface of the rim 226 at one of the projections 244 or at a location between two adjacent concave facets 242. The handle can have the same thickness as the rim so as to blend in with the rim and can have rounded upper corners for a smooth appearance.

Figure 11:
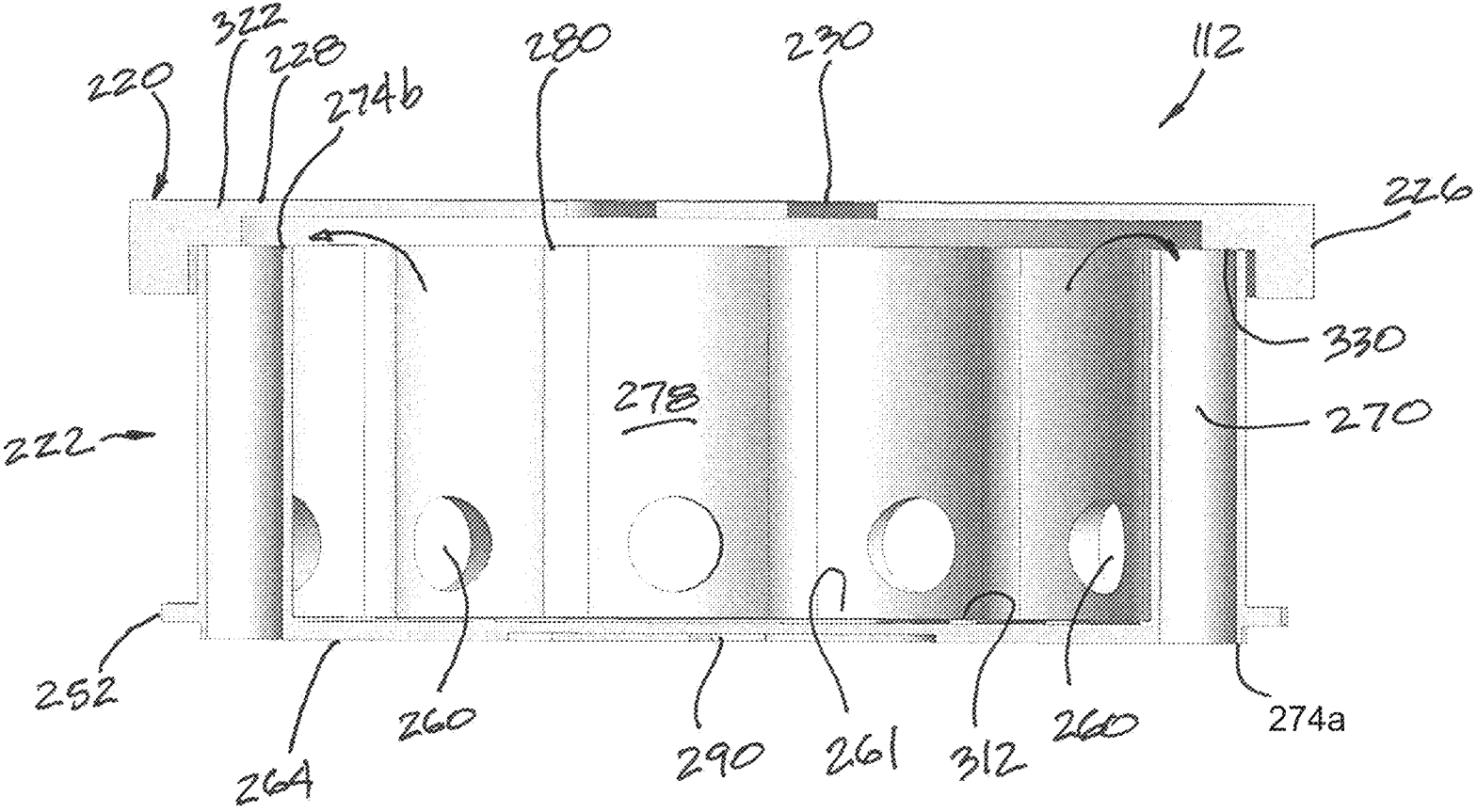
FIG. 11 in an enlarged side cross-sectional view of a heating unit in accordance with aspects of the present invention.
Figure 13:
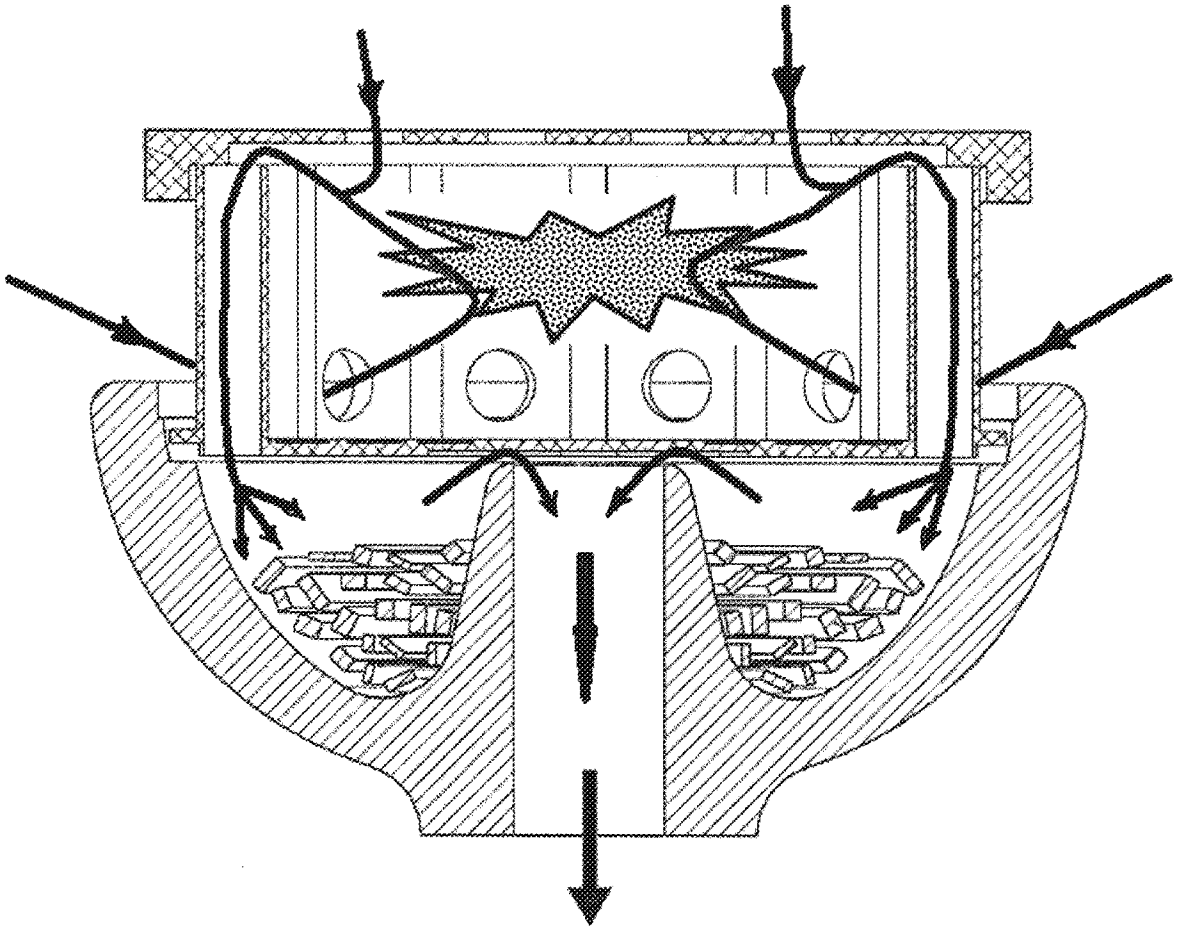
FIG. 13 is a schematic diagram showing an exemplary gas flow pattern when a heating unit of the present invention is placed in service.

With reference now to FIGS. 11 and 13 and further reference to FIGS. 1 and 2, a cross-sectional side view of the heating unit 112 is shown. In use with the heating unit 112 located atop a tobacco bowl or head 110 of a hookah 100 and a fuel or a heat source, such as wood, coal, or charcoal, is placed into the combustion chamber 278 and ignited to burn, the heat source heats the surrounding gas inside the combustion chamber 278 and causes the hot gas to rise towards the lid 220. In an example, the hot gas can flow out of the top vents 230 provided with the lid 220 and flow through the top end openings 274*b* of the plurality of thermal vents 270 to then flow out the bottom end openings 274*b* and into the receiving space 174 of the bowl 110 to heat the cooking element 115 located therein. However, as a user applies a vacuum to the hookah 100 by inhaling at the mouthpiece to create a vacuum in the vapor chamber 94 (FIG. 1), fresh air can be drawn through the top vents 230 formed with the lid 220.

As hot gas will flow in the direction of least resistance, some of the hot gas will discharge out the top vents 230 while some will flow through the plurality of thermal vents 270. But if the user inhales at the mouthpiece and creates a vacuum, most if not all of the hot gas will flow through thermal vents 270 only. Thus, in embodiments of the present invention, the relative opening sizes and passages of the top vents 230 and thermal vents 270 are controlled so that the majority if not all of hot gas will be directed in through the thermal vents 270 to then heat the cooking element 115 located in the tobacco bowl 110 (FIGS. 2 and 13). For example, the top vents 230 can be sized with relatively small openings compared to the opening sizes and the number of openings of the thermal vents 270. In still other examples, a louver or a control mechanism can be provided with the lid 220 to regulate the opening sizes of the top vents 230 from full opening, fully closed, or partially closed. By varying the opening sizes of the top vents 230, more or less hot gas flow can be directed through the thermal vents 270 and less to nearly zero out the top vents. Again, when a vacuum is applied to the hookah, most if not all of the hot gas will flow through the thermal vents 270 and not out the top vents 230 with possible fresh air also coming through the top vents 230 and into the combustion chamber 278 for reaction with the fuel and/or hot gas and then flow in through the top end openings 274*b* of the thermal vents 270.

In an example, a louver in the form of a top cover, such as a thin metal sheet or plate, can be placed over the exterior surface 322 of the top wall 228 of the lid 220. The top cover can be slid to one side of the lid or the other to control the opening sizes of the top vents. In other examples, the top cover can be rotatably connected to the top wall, such as by incorporating a pin to project into a boss located in the top wall. The top cover can be provided with similar top vent openings as the lid 220 but offset so that when angularly aligned, the openings of the top vents 230 are either fully opened, fully closed, or somewhere in between. The opening sizes of the top vents 230 can be controlled by rotating the top cover about the pin to vary the opening sizes of the top vents 230 of the lid.

In still other examples, a second similarly shaped lid, i.e., a secondary lid, but larger can be placed over the existing lid 220. The secondary lid can be provided with similarly shaped vent openings but offset so that when angularly aligned, the openings of the top vents 230 are either fully opened, fully closed, or somewhere in between. The opening sizes of the top vents 230 can be controlled by rotating the secondary lid about the rim 226 of the lid 220 to vary the opening sizes of the top vents 230 of the lid 220.

In still yet other examples, the heating unit 112 can be used as shown without any added top cover located over the lid 220. Instead, gas flow can be controlled by controlling the opening sizes and the number of openings of the top vents 230 versus the thermal vents 270.

As hot gas rises and the combustion chamber 278 experiences a slight vacuum, fresh air from the side air vents 260 located on the base wall 250 of the base 222 and optionally through the top vents 230 of the lid 220, especially when a louver system is used with the lid to control the openings of the top vents. The fresh air is needed for the fuel located inside the combustion chamber 278. In an example, the internal surface features of the base 222, such as the concave facets 256I and the projections 258I, provide disruptions so that when hot gas flows thereacross, the hot gas is redirected or deflected by the surface features to create additional mixing. Said differently the knuckles 304 and the arcuate surfaces 256I of the interior wall surface can enhance gas mixing within the combustion chamber 278. In alternative embodiments, internal fins, projections, and/or baffles may be provided to the interior of the base 222 to further facilitate mixing.

Figure 12:
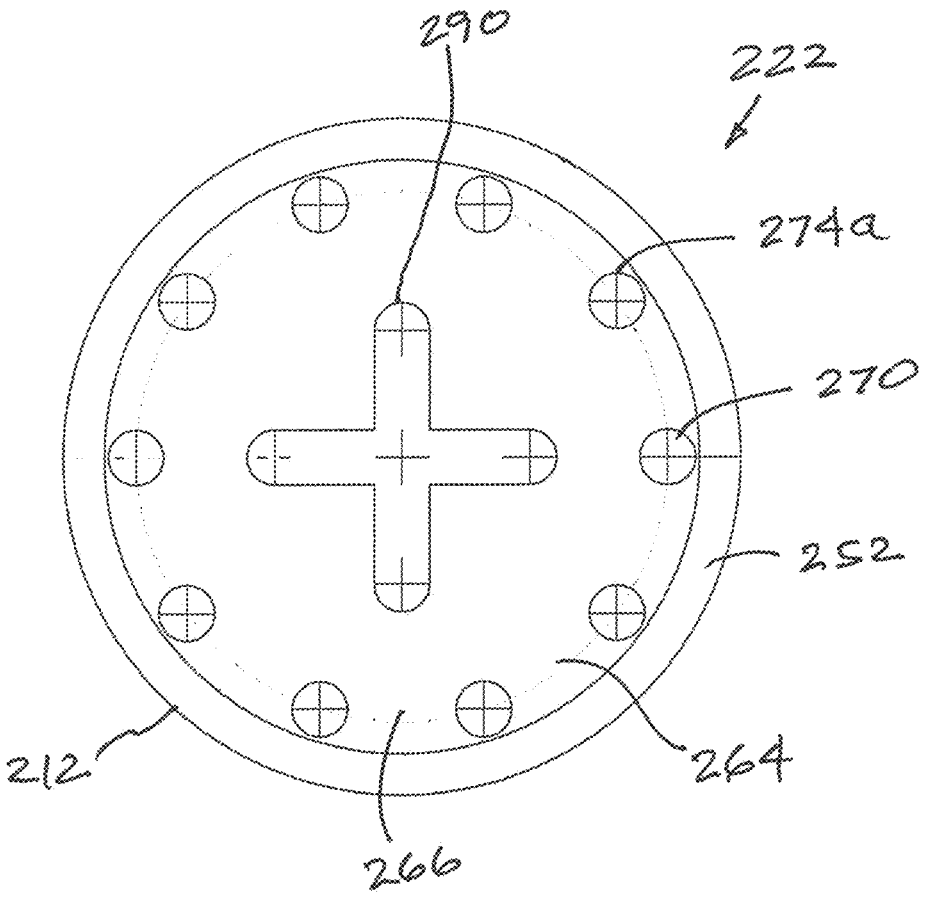
FIG. 12 is bottom plan view of a base in accordance to further aspects of the present invention.

FIG. 12 is a bottom plan of a base 222 provided in accordance to further aspects of the present invention. In an example, the base 222 of the present embodiment is similar to other bases described elsewhere herein and can be used in the same way, such as shown in FIG. 5, with at least one exception. In the present embodiment, the number of thermal vents 270 have been reduced to ten. However, in other embodiments, the number of thermal vents can be less than ten or greater than ten. The present base 222 may be used in similar manners as discussed elsewhere herein for other bases. Further, with fewer or more thermal vents incorporated in the alternative base, a lid can be modified correspondingly to fit with the modified base.

FIG. 13 is a schematic diagram showing an exemplary gas flow pattern when a heating unit of the present invention is placed in service.

Methods of making hookah devices and components thereof and methods of using the disclosed hookah devices and components thereof, including of heating units, are within the scope of the present invention.

Although various embodiments of hookah devices and components thereof, such as embodiments of heating units are described above, other hookahs that add, alter, combine and/or remove components are possible in accordance with various other embodiments of the invention. Furthermore, although the invention has been discussed with respect to various embodiments, it should be recognized that the invention comprises the novel and non-obvious claims supported by this disclosure.

What is claimed is:

1. A hookah device comprising:

a heating unit comprising a base having a structure defining a combustion chamber and a lid, the base comprising:

a sidewall having a wall structure, an exterior surface and an interior surface defining a thickness and a wall height;

surface ornamentations formed with the exterior surface, the interior surface, or both;

a bottom wall attached to the sidewall;

at least one air vent formed through the sidewall to expose the combustion chamber to fresh air flow; and a thermal vent formed through the sidewall at a location proximate the between the interior surface and the exterior surface, said thermal vent having a top end opening at a top edge of the sidewall and a bottom end opening at an exterior surface of the bottom wall; and the lid comprising a top wall and a rim.

2. The hookah device of claim 1, wherein a groove is provided at an interior surface of the bottom wall, said groove sized and shaped for air flow.

3. The hookah device of claim 1, wherein the top wall of the lid comprises at least one top vent.

4. The hookah device of claim 1, wherein the surface ornamentations are formed with both the interior surface and the exterior surface.

5. The hookah device of claim 4, wherein the surface ornamentations comprise twelve internal projections, twelve external projections, twelve internal concave facets, and twelve external concave facets.

6. The hookah device of claim 5, wherein an internal projection and an external projection together define a knuckle and wherein the thermal vent extends through the sidewall at the knuckle.

7. The hookah device of claim 4, wherein the surface ornamentations comprise ten internal projections, ten external projections, ten internal concave facets, and ten external concave facets.

8. The hookah device of claim 1, wherein the base comprises at least four spaced apart air vents and at least four spaced apart thermal vents.

9. The hookah device of claim 1, further comprising a handle extending from the rim of the lid.

10. The hookah device of claim 1, wherein the surface ornamentations of the base comprise spaced apart arcuate surfaces and surface ornamentations of the lid comprise spaced apart projections.

11. A method of manufacturing a hookah comprising:

forming a base comprising a water bowl;

placing a pipe having a downstem into the base;

attaching a tobacco bowl at an end of the pipe, said tobacco bowl having a first opening having a larger dimension than a second opening;

placing a cooking element into the tobacco bowl at the first opening;

placing a heating unit above the tobacco bowl, the heating unit comprising a heating unit base having a structure defining a combustion chamber and a lid, the heating unit base comprising:

a sidewall having a wall structure, an exterior surface and an interior surface defining a thickness and a wall height;

surface ornamentations formed with the exterior surface, the interior surface, or both;

a bottom wall attached to the sidewall;

at least one air vent formed through the sidewall to expose the combustion chamber to fresh air flow; and a thermal vent formed through the sidewall at a location between the interior surface and the exterior surface, said thermal vent having a top end opening at a top edge of the sidewall and a bottom end opening at an exterior surface of the bottom wall; and the lid comprising a top wall and a rim.

12. The method of claim 11, further comprising attaching a hose onto an end of a hose port, said hose port being in communication with an interior of the water bowl.

13. The method of claim 11, wherein the heating unit base comprises at least four spaced apart air vents and at least four spaced apart thermal vents.

14. The method of claim 11, wherein the surface ornamentations of the base comprise spaced apart arcuate surfaces and surface ornamentations of the lid comprise spaced apart projections.

15. A heating unit for use with a hookah device comprising a base having a structure defining a combustion chamber and a lid for placement onto the base;

wherein the base comprises:

a sidewall having a wall structure, an exterior surface and an interior surface defining a thickness and a wall height;

surface ornamentations formed with the exterior surface, the interior surface, or both;

a bottom wall attached to the sidewall;

at least one side air vent formed through the sidewall to expose the combustion chamber to fresh air flow; and a thermal vent formed through the sidewall between the interior surface and the exterior surface, said thermal vent having a top end opening at a top edge of the sidewall and a bottom end opening at an exterior surface of the bottom wall; and wherein the lid comprises:

a top wall having at least one top vent; and a rim depending from the top wall; and wherein the rim comprises surface ornamentations.

16. The heating unit of claim 15, wherein the base comprises at least four spaced apart air vents and at least four spaced apart thermal vents.

17. The heating unit of claim 15, wherein the surface ornamentations of the base comprise spaced apart arcuate surfaces and surface ornamentations of the lid comprise spaced apart projections.

* * * * *